US006146235A

United States Patent [19]

Migliorati

[11] Patent Number: 6,146,235

[45] Date of Patent: Nov. 14, 2000

[54] MOVEMENT ASSEMBLY, PARTICULARLY FOR THE LEGS OF A DOLL

[75] Inventor: Sostene Migliorati, Pavone Del Mella, Italy

[73] Assignee: Giochi Preziosi S.p.A., Milan, Italy

[21] Appl. No.: 09/007,813

[22] Filed: Jan. 15, 1998

[30] Foreign Application Priority Data

May 20, 1997 [IT] Italy ..... MI97A1181

[51] Int. Cl.[7] ..... A63H 11/18

[52] U.S. Cl. ..... 446/355; 446/377

[58] Field of Search ..... 446/276, 277, 446/285, 293, 294, 354, 355, 356, 377, 376; 40/418, 420

[56] References Cited

U.S. PATENT DOCUMENTS

| | | | |
|---|---|---|---|
| 1,649,910 | 11/1927 | Mik . | |
| 1,727,818 | 9/1929 | Eyring | 446/355 |
| 1,986,446 | 1/1935 | Powleson | 446/355 |
| 1,992,477 | 2/1935 | Domowitch et al. | 446/355 |
| 2,147,215 | 2/1939 | Price | 446/355 |
| 2,667,719 | 2/1954 | Edwardson . | |
| 2,763,095 | 9/1956 | Stearns . | |
| 2,887,822 | 5/1959 | Baggott | 446/377 |
| 2,906,059 | 9/1959 | Berger . | |
| 3,267,608 | 8/1966 | Ryan . | |
| 3,484,988 | 12/1969 | Robbins . | |
| 3,582,079 | 6/1971 | Breslow | 446/355 |
| 3,665,644 | 5/1972 | Rapp . | |
| 4,177,602 | 12/1979 | Choi . | |
| 4,302,903 | 12/1981 | Pun | 446/355 |
| 4,795,395 | 1/1989 | Oishi et al. | 446/355 |
| 5,224,896 | 7/1993 | Terzian . | |

FOREIGN PATENT DOCUMENTS

| | | | |
|---|---|---|---|
| 743083 | 11/1996 | European Pat. Off. . | |
| 571287 | 2/1933 | Germany | 446/356 |
| 700195 | 11/1940 | Germany | 446/355 |
| 1066925 | 10/1959 | Germany | 446/355 |
| 2 006 927 | 9/1971 | Germany . | |
| 444827 | 11/1949 | Italy | 446/355 |
| 240175 | 11/1925 | United Kingdom . | |
| 1256430 | 12/1971 | United Kingdom . | |
| 2 022 426 | 12/1979 | United Kingdom . | |
| 2163059 | 2/1986 | United Kingdom . | |
| 2258820 | 2/1993 | United Kingdom . | |
| WO 00/07680 | 2/2000 | WIPO . | |

*Primary Examiner*—Jacob K. Ackun
*Assistant Examiner*—Jeffrey D. Carlson
*Attorney, Agent, or Firm*—Jacobson, Price, Holman & Stern, PLLC

[57] ABSTRACT

A movement assembly particularly for the legs of a doll comprises a geared transmission whereof the end wheel, supported on the body structure of the doll, has two opposite eccentric pins (48,48'), one for eah leg. On each of the pins a movable U-shoped element (50') is rotatably engaged and is mounted and restrained to the body structure of the doll in order to be driven by the respective eccentric pin in an upward and downward motion and simultaneously an oscillating movement. The U-shaped element has a pin (58) for assembly of the leg, which can be mounted thereon with the possibility of being rotated around the pin.

7 Claims, 3 Drawing Sheets

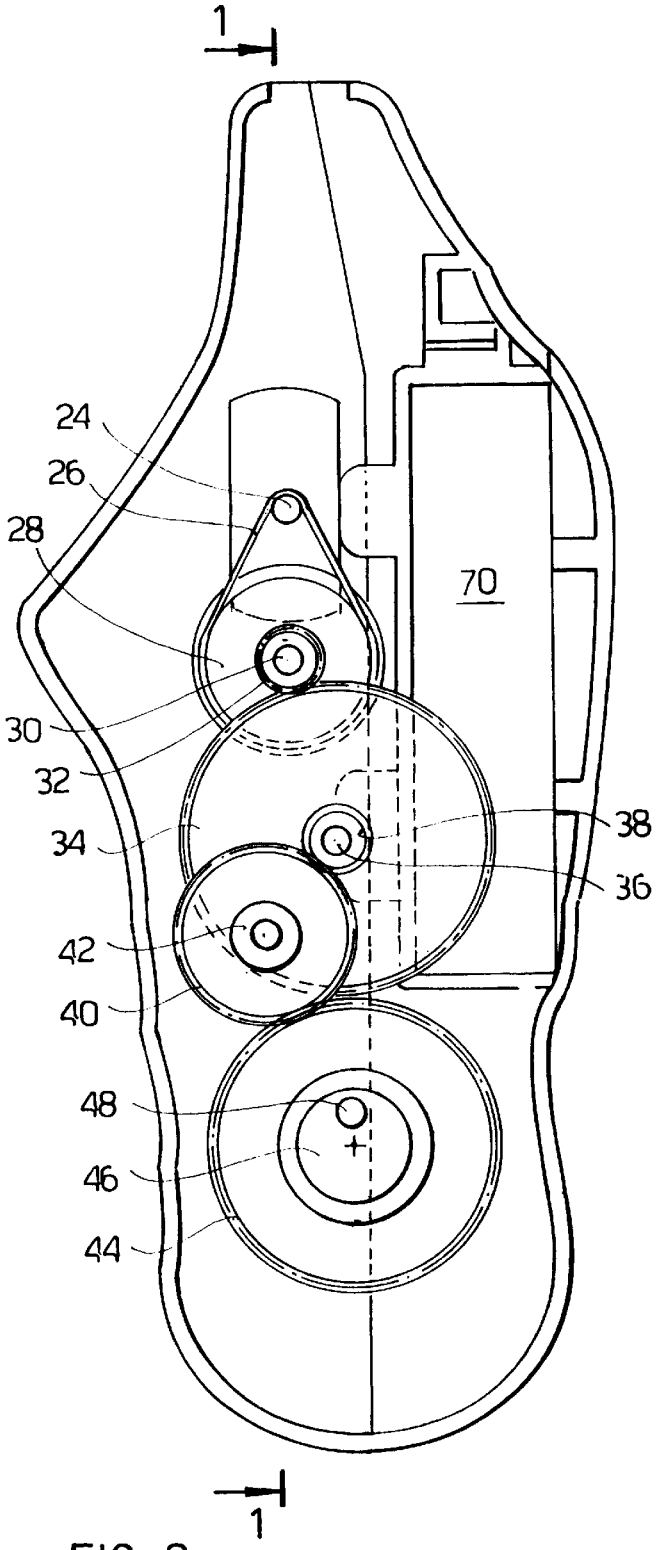
FIG. 2
FIG. 3
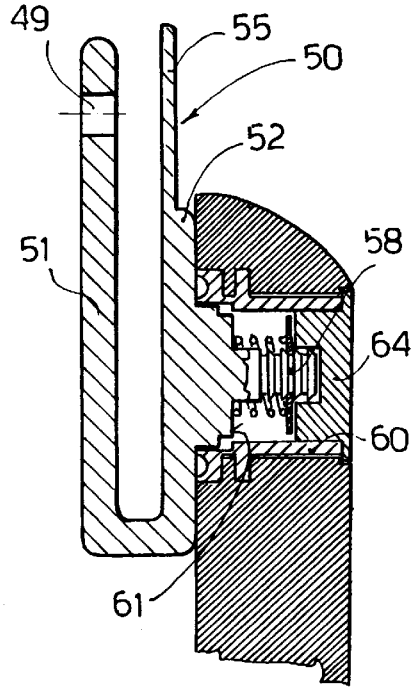
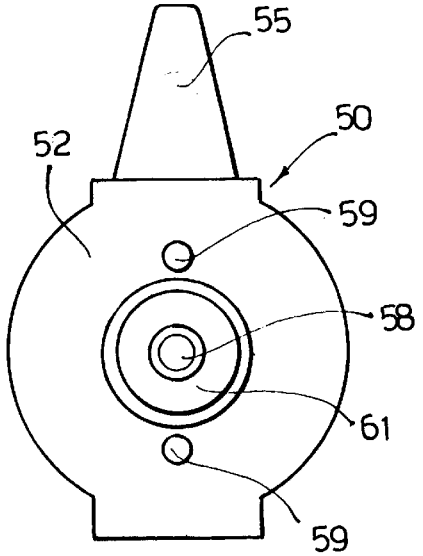
FIG. 4

MOVEMENT ASSEMBLY, PARTICULARLY FOR THE LEGS OF A DOLL

DESCRIPTION

The invention relates to the field of movement mechanisms for the limbs of a toy, in particular to the mechanisms for moving the legs of a doll, in order to simulate a walking motion.

A number of mechanisms for simulating the walking movements in a doll have already been designed. A common problem for these mechanisms is restricting the overall dimensions of the same so that they can be inserted in a body structure of a doll, even one small in size.

A previous patent application describes a mechanism of the above type which moves an end gear, starting from a worm screw driven by a battery-powered motor. The end gear has two off-center means, at 180° from each other, which move rigid wires placed in the legs of the doll. Difficulties have been encountered in achieving movement from a worm screw. A further disadvantage of the prior mechanism is that it can only be applied to dolls having legs integral with the body, while it cannot be usefully applied to dolls with jointed legs.

Moreover the movement mechanisms currently available on the market for the movement of jointed dolls involve a transmission with several gears, with considerable bulk, which cannot be miniaturized in order to adapt them to so-called "fashion dolls", which are normally small in size.

An object of the invention is therefore to achieve movement of the legs of a doll effectively and similarly to a walking motion, with means which are small in size.

A further object of the invention is to obtain such a system of movement which can be used for dolls with jointed or articulated legs.

These objects and others of the invention have been achieved with an assembly as mentioned in claim 1. Additional features are listed in subsequent claims.

In other words the new movement mechanism assembly comprises, starting from a driving shaft contained in a doll body structure, a gear-wheel transmission supported inside the body structure, which ends with an output wheel which holds on two opposite faces two eccentric pins, which are angularly off set by approximately 180° one in relation to the other. Each pin is rotatably engaged in a leg support-leg engaging element. Each leg support element has a U shape, with one branch of the U engaged on the eccentric pin. The leg support element is also engaged in a special opening of the body structure. The second branch of the U holds per se known means, which are suitable for engaging an end of a leg of the doll so that it can be rotated around the axis of the pin.

The new assembly can easily be manufactured in a small size and at a low cost; it allows a walking movement which is fairly similar to that of humans; it can be adapted for dolls with jointed legs.

These and other features and advantages of the invention will be made clearer hereinunder by a description thereof given only by way of a non-limiting and illustrative example, with reference to the accompanying drawings, in which:

FIG. 2 is a sectional view taken substantially along plane 2—2 in FIG. 1;

FIG. 3 is an enlarged sectional view of a U-shaped leg-holding element, with an upper part of the leg mounted thereon;

FIG. 4 is a side view of the leg-holding element, from the right in relation to FIG. 3;

Figure 1:
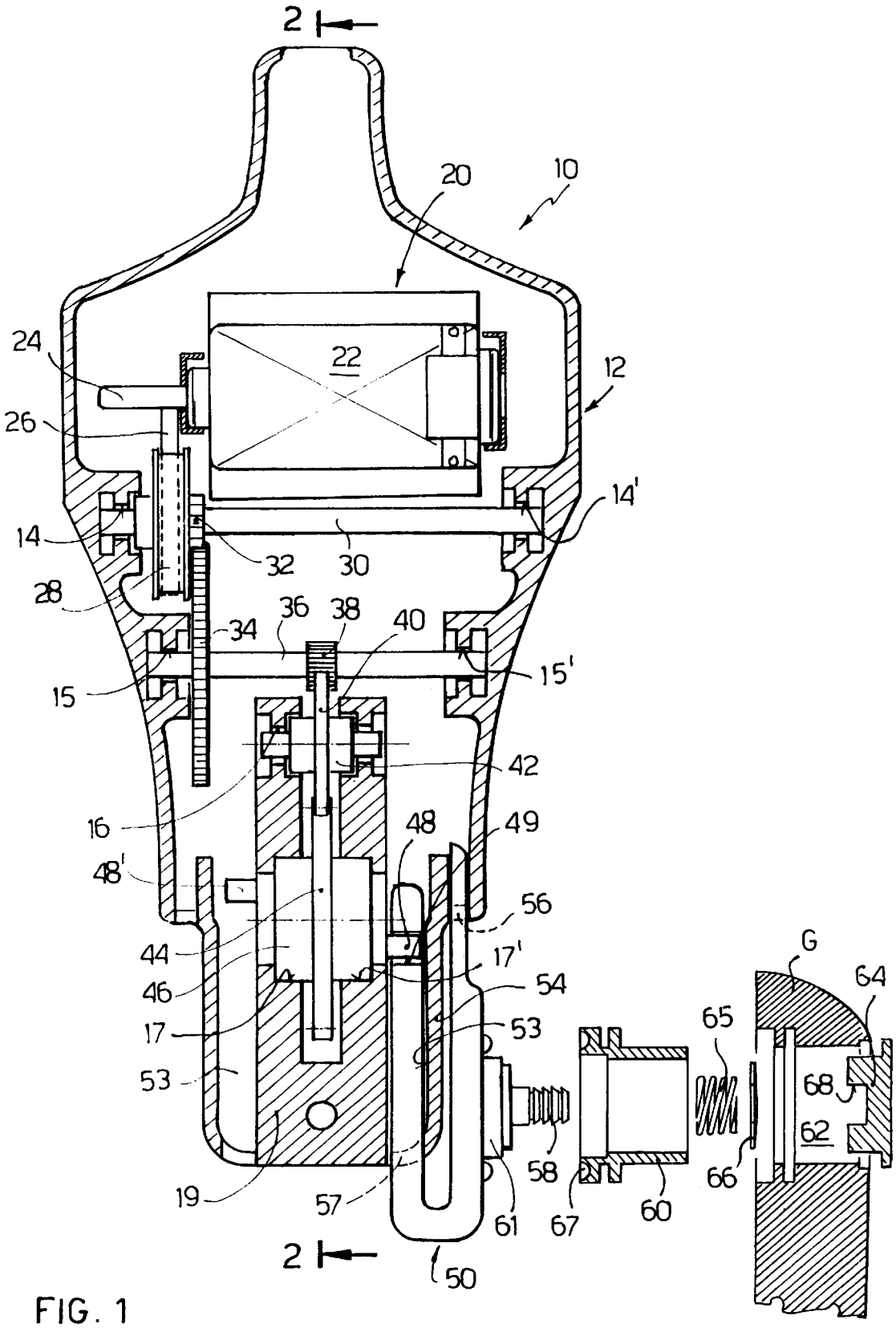
FIG. 1 is a sectional view taken along a plane denoted schematically by 1—1 in FIG. 2, through a body structure of a doll; the transmission mechanism is shown in side view.
Figure 5:
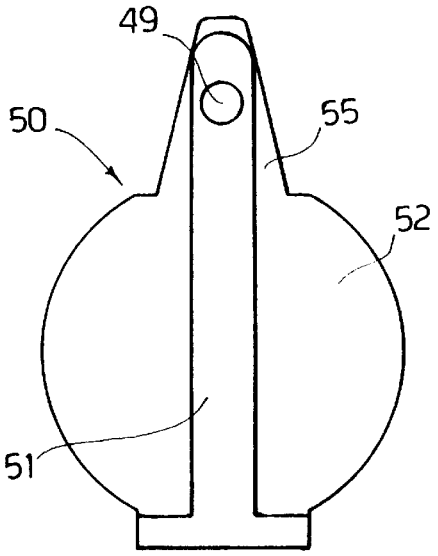
FIG. 5 is a side view of the leg-holding element, from the left in relation to FIG. 3.

In the drawings, the assembly of the invention is referenced by 10. It comprises, in a doll's body structure as a whole referenced 12, pairs of aligned housings 14, 14' and 15, 15' vertically spaced one from the other, for holding shafts of gears or pulleys. Further housings 16, 16' and 17, 17' are made in a central body part referenced 19. A movement mechanism, referenced 20 as a whole, comprises a motor 22 whose driving shaft 24 is connected, via a belt 26 and a pulley 28, in order to rotate a shaft 30 with the ends held in the housings 14, 14'. A pinion 32 is mounted on the shaft 30 and meshes with a gear wheel 34 held by a shaft 36. The shaft 36 is rotatably housed in the housings 15, 15' of the body. The shaft 36 holds in turn a pinion 38 which meshes with a gear wheel 40 carried by a rotating hub 42 held in the housings 16, 16'. The gear wheel 40 meshes with an end gear wheel 44 carried on a hub or short shaft 46, which is rotatably held in the housings 17, 17'. Two eccentric pegs or pins, referenced 48 and 48' respectively, are integral with the cogged wheel 44, on opposite faces of the hub 46. Said pins project laterally and are peripherally spaced by 180° one from the other. Each pin 48 engages a hole 49 of a leg-holding element, or leg support element generally referenced 50. One single leg-holding element 50 is drawn; it is understood that a similar element (not shown) is engaged on the pin 48'. The leg-holding element 50 is U shaped in front view, and comprises a first branch 51 and a second branch 52. The first branch has said opening 49 and is housed in a housing 53 of the body structure of the doll formed between the central body 19 and a lateral wall 54. A lower part of the U projects through a slot 57 in the body of the doll and the branch 52 of the U is positioned partly outside the lateral wall 54 of the body structure and ends with a tapered part 55 which is housed inside the body structure through an opening 56. Either slot 57 or opening 56 has a limited extension, slightly greater than the width of the element part 50 engaged therein. The branch 52 has, on its surface which is facing outwards, a pin 58 and circumferentially spaced stop projections 59, 59. A leg G of a doll, or a substantially rigid part thereof, is mounted on toothed pin 58 by means of a bushing 60 housed in a space 62 of the leg, and a plug 64 with cavity 68. A spring 65 and washer 66 are placed between a shoulder 61 of the U-shaped element and the plug 64. The leg is restrained on the pin 58 by means of the pin teeth which engage the cavity 68 in the plug 64.

Figure 7:
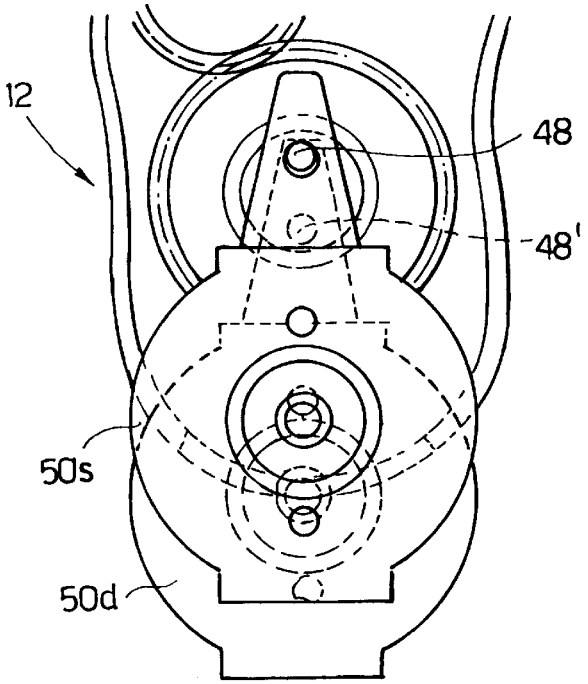
FIG. 7 shows two vertically off-set positions, which the right-hand and left-hand leg-holding elements can assume during the walking motion.
Figure 6:
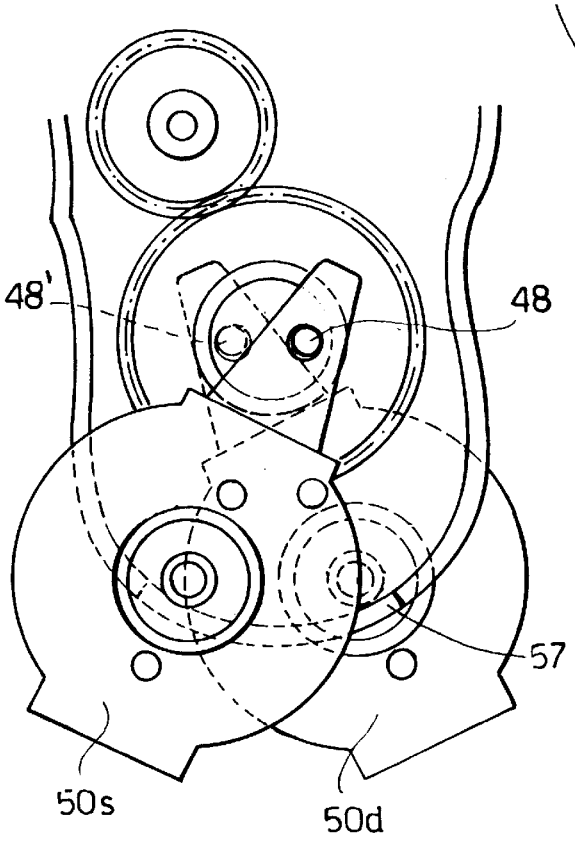
FIG. 6 shows two angularly off-set positions which the two right-hand and left-hand leg-holding elements can assume during the walking motion; the section plane of the drawing is like that of FIG. 2.
Figure 8:
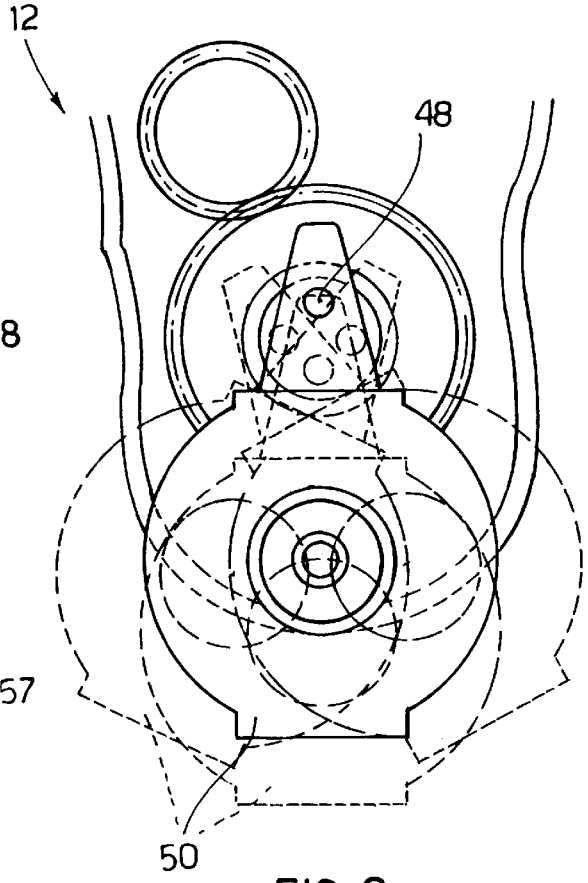
FIG. 8 shows various possible positions for the same leg-holding element during an operating cycle.

When movement is transmitted to the driving shaft 24 from the motor 22, powered for example by batteries (reference numeral 70 denotes a space for batteries in the body of the doll), each eccentric pin 48, 48' transmits to the relevant leg-holding element a reciprocating upward and downward movement and, due to the fact that the walls of opening 57 or of opening 56 act as a fulcrum, also an oscillation movement combined therewith, as can be seen in FIGS. 6, 7 and 8. This movement imitates to a considerable extent the movement of the legs of a walking person. More particularly, with reference to FIGS. 6 and 7, a right-hand leg-holding element of the doll has been denoted by 50*d*, and a left-hand leg-holding element by 50*s*. It can be seen from FIG. 6 that the two legs take up a scissors-like position when the pegs 48, 48' are arranged with their axes in a horizontal plane (FIG. 6) while they assume a vertically off-set position when the two pegs 48, 48' are aligned with their axes in a vertical plane (FIG. 7). As can be seen from FIG. 8, the leg of the doll moves in a movement which largely imitates human walking.

It can be seen how the fact of supporting the axles of the gear wheels in special housings formed in the body structure of the doll enables the mechanism to be miniaturized in order to allow its use also in small-sized dolls.

What is claimed is:

1. A movement assembly for limbs of a toy, comprising a body structure, a motor device, an end wheel, a movement transmission mechanism between said motor device and said end wheel, said end wheel having eccentric pins on opposite faces, angularly spaced one from the other, a leg-holding element rotatably engaged on one of said pins, said leg-holding element having a U shape, a first branch of the U, engaging with said pin and a second branch of the U holding a leg, the second branch of the leg-holding element including a toothed pin which engages a plug of the leg for restraining the leg.

2. A movement assembly according to claim 1, wherein the leg-holding element is also engaged in a slot of the body structure to achieve an oscillating movement caused by the movement of said pin.

3. A movement assembly according to claim 1, wherein the leg is mounted on the pin by a bush and a pressure spring, with a washer.

4. A movement assembly according to claim 1, wherein the end wheel is integral with a hub which is rotatably housed in a housing formed in a central part of the body structure.

5. A movement assembly according to claim 1, wherein housings for rotatably holding shafts of the mechanism are formed directly in the body structure.

6. A movement assembly according to claim 1, wherein the mechanism comprises, downstream of a driving shaft, a belt which receives motion from said driving shaft and moves a pulley, said pulley being integral with a first shaft which holds a pinion, said pinion meshing with a gear wheel of a second transmission shaft which holds an additional pinion; the additional pinion meshing with a gear wheel housed in a central part of the body structure of the toy, the additional wheel meshing with the output wheel.

7. A movement assembly for limbs of a doll comprising a body structure with at least one leg, a motor device, an end wheel, a movement transmission mechanism between said motor device and said end wheel, said end wheel having eccentric pins on opposite faces, angularly spaced one from the other, a leg holding element rotatably engaged on one of said pins and having an engagement device for the leg, said leg holding element being allowed to make an up and down reciprocating movement together with an oscillating movement caused by movement of said pin, in accordance with rotation of said end wheel, and being provided with a portion that is partially located on an exterior of said body structure, said leg holding element also being connected to the respective leg of the doll on the exterior surface of the portion located outside of said body structure, said leg holding element having a U shape, a first branch of the U engaging with said pin and a second branch of the U being connected to said leg, a tip portion of said second branch being inserted into a slot provided in said body structure and having counterfaced end walls at a distance slightly greater than a width of said leg holding element so as to transmit oscillating movement to the leg holding element with said inner walls of said slot acting as a fulcrum.

* * * * *